United States Patent [19]

Mattsson

[11] 4,296,679

[45] Oct. 27, 1981

[54] CYLINDER WITH TWO-STAGE MOVEMENT, ESPECIALLY A WELDING CYLINDER

[75] Inventor: Karl-Erik H. Mattsson, Näsum, Sweden

[73] Assignee: AB Volvo, Gothenburg, Sweden

[21] Appl. No.: 90,055

[22] Filed: Oct. 31, 1979

[30] Foreign Application Priority Data

Nov. 7, 1981 [SE] Sweden ..... 7811488

[51] Int. Cl.[3] ..... F01B 7/20

[52] U.S. Cl. ..... 92/52; 92/53; 92/65; 92/85 R; 92/113

[58] Field of Search ..... 91/167 R; 92/51, 52, 92/53, 65, 85 R, 113, 62.65

[56] References Cited

U.S. PATENT DOCUMENTS

| | | | |
|---|---|---|---|
| 612,507 | 10/1898 | Rothe | 91/167 |
| 2,358,826 | 9/1944 | Purat | 91/167 |
| 2,490,625 | 12/1949 | Hall | 91/167 |
| 2,649,693 | 8/1953 | Venus | 91/167 |
| 3,150,563 | 9/1964 | Carrigan | 91/167 |
| 3,570,230 | 3/1971 | Pool | 92/65 |

FOREIGN PATENT DOCUMENTS

| | | | |
|---|---|---|---|
| 1441977 | 7/1976 | United Kingdom | 92/65 |

*Primary Examiner*—Abraham Hershkovitz
*Attorney, Agent, or Firm*—Young & Thompson

[57] ABSTRACT

In a cylinder with a two-stage movement, a first piston moves in a housing, and in the first piston a second piston moves, which has a piston rod sliding in an end of the housing. On its side facing away from the piston rod, the second piston is provided with a guide member which is guided in the first piston. The first piston can be held in a position in which the piston rod is extended far out of the housing. With the aid of the second piston, the piston rod can perform a certain axial movement relative to the first piston, at the same time as guiding is effected with the aid of the guide member and the first piston.

5 Claims, 2 Drawing Figures

CYLINDER WITH TWO-STAGE MOVEMENT, ESPECIALLY A WELDING CYLINDER

The present invention relates to a cylinder with two-stage movement, especially a welding cylinder for use in welding, in which a first piston, which seals against the inside of a housing, is axially displaceable in the housing, and in which a second piston, arranged coaxially with the first piston, seals in an axial cavity in one end of the first piston, is axially displaceable in said cavity and carries a piston rod which slides sealingly through one housing end which faces the cavity in the first piston, and in which in the other housing end there is arranged a pressure medium inlet tube which extends through the first piston and into the piston rod, via which tube pressure medium can be brought into or out of a first chamber delimited by the first and the second pistons, and in which the chambers in the housing, on both sides of the first piston, a second and a third chamber, have pressure medium connections.

In welding cylinders it is desirable to achieve the best possible guiding of the piston rod to maximize the work precision. In a normal work position, the first piston will be close to one housing end, and the second piston in the welding strokes will therefore move back and forth in the vicinity of this end. This will result in the guiding of the piston rod being highly dependent on the play between the piston rod and the housing end through which the piston rod extends. The work precision obtained thereby is often less than that desired.

To improve the work precision, it is possible to use a cylinder with one-stage movement, with a single piston in a housing. On its side facing away from the piston rod, the piston has a guide slidable in the other housing rod. While this does improve the precision, to achieve flexibility with such a cylinder the work strokes must be made relatively long, something which is both time-consuming and increases the consumption of pressure medium. It often also requires additional space.

The purpose of the invention is to eliminate said disadvantages and to achieve a cylinder in which the piston rod has improved guiding, but in which the cylinder still has a short and compact construction.

This is achieved according to the invention by the second piston being provided, on its side facing away from the piston rod, with a tubular, axially oriented guide member which is sealingly guided in the first piston and is slipped onto the inlet tube and seals against the outside of the tube. This improves the guiding of the piston rod via the guide member, and retains the two-stage movement.

The guide member can suitably pass through the first piston, so that the guide member can be made somewhat shorter.

The invention will be described below with reference to an embodiment shown in the accompanying drawings, in which.

Figure 1:
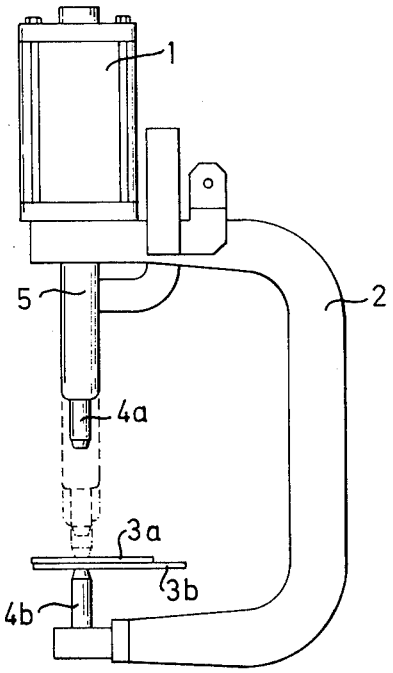
FIG. 1 shows the use of a cylinder according to the invention.

FIG. 1 shows schematically how a cylinder 1 according to the invention is used as a welding cylinder and is mounted in a frame 2 where it is used to fix two pieces 3*a* and 3*b* which are to be welded together with the aid of two welding electrodes 4*a* and 4*b*. The welding electrode 4*a* is movable and is carried by a piston rod 5 of the cylinder 1 or by an extension member of this piston rod, while the welding electrode 4*b* is stationary and is carried by the frame 2.

At rest, when changing work pieces for example, the movable welding electrode 4*a* assumes the uppermost position shown with solid lines. When welding is to be done, the electrode 4*a* is first moved to a work position indicated with dashed lines, where the pieces 3*a* and 3*b* are placed in the correct position for welding. Welding electrode 4*a* is thereafter moved to the lowest welding position, shown with dash-dot lines where the pieces 3*a* and 3*b* are pressed together and the welding is performed. When changing the welding point, the electrode 4*a* is retracted to the position shown with dashed lines so that the pieces 3*a* and 3*b* can be moved the required distance. It may also be necessary to move the electrode 4*a* all the way back to the rest position, depending on the shape of the pieces 3*a* and 3*b*.

Figure 2:
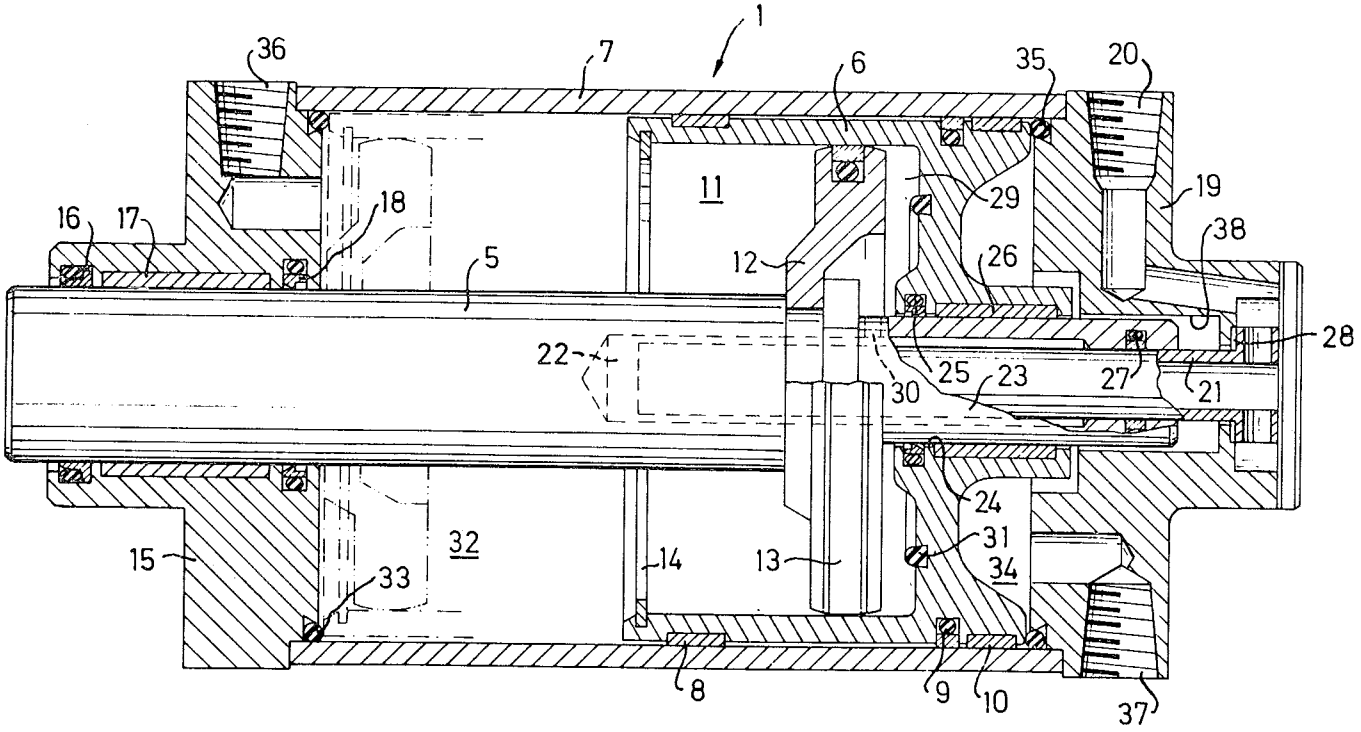
FIG. 2 shows a longitudinal section through a cylinder according to the invention.

A more detailed view of the construction of the cylinder 1 according to the invention is given in FIG. 2. A first piston 6 is axially displacable in a housing 7 and seals against the inside of the housing with the aid of a sealing ring 9 which is located between two slide rings 8 and 10. At its one end the first piston 6 is provided with an axial cavity 11 in which a second piston 12 moves, which is coaxial with the first piston 6. The second piston 12 seals against the first piston 6 with the aid of a seal 13, and is kept in the cavity 11 with the aid of a lock ring 14.

The piston rod 5 of the cylinder 1 is fastened to the second piston 12 and extends through a first housing end 15 which faces the cavity 11 in the first piston 6 and is sealed against the end 15 with the aid of seals 16 and 18, between which there is a bushing 17.

At the other housing end 19 there is a pressure medium connection 20 which communicates with the interior of an inlet tube 21 that is mounted in the housing end 19 and that extends parallel to the piston rod 5 and extends with its free end into an axial cavity 22 in the same. On the side of the second piston 12 facing away from the piston rod 5, there is a guide member 23, which is tubular and which is guided in an axial hole 24 in the first piston 6. A seal 25 seals between the first piston 6 and the guide member 23 which slides in a bushing 26 in the first piston 6. The guide member 23 is slipped onto the inlet tube 21 and seals at its free end against the same with the aid of a seal 27.

Between the inlet tube 21 and the housing end 19, there is a seal 28 whereby the inlet tube 21 is movably supported in the housing end 19 and can be tipped to a certain degree without danger of leakage.

The first piston 6 and the second piston 12 define together a first chamber 29 which communicates, via at least one pressure medium opening 30 and the interior of the inlet tube 21, with the pressure medium connection 20. The pressure medium opening 30 is in this case located in the guide member 23, but it can also be located in the second piston 12, for example. The first piston 6 carries a buffer 31 against which the second piston 12 abuts in its most retracted position in the cavity 11. The buffer 31 also functions as a seal when the second piston 12 is completely retracted, thus reducing the need for other piston seals. The piston rod 5 extends into a second chamber 32, where there is a seal 33 at the transition between the housing 7 and the housing end 15. Said seal 33 protrudes slightly into the chamber 32. Between the housing end 19 and the first piston 6, there is a third chamber 34 in which, at the transition between the housing 7 and the housing end 19, there is a seal 35 which protrudes slightly into the chamber 34. In one housing end 15 there is a pressure medium connection 36 which communicates with the second chamber 32. In the other housing end 19 there is a pressure medium connection 37 which communicates with the third chamber 34.

The cylinder 1 according to the invention functions in the following manner:

When one desires to achieve the best working position relative to the work pieces 3*a* and 3*b* with the aid of the piston rod 5, pressure medium is supplied via the pressure medium connection 37 to the third chamber 34. Thus the first piston 6 is moved from its rest position shown in FIG. 2 where it sealingly abuts the seal 35, to the left in the figure, to the position shown with dash-dot lines, so that its opposite side abuts the seal 33. The first piston 6 can now be held in this position by maintaining the pressure in the third chamber 34. The piston rod 5 has thus been moved a relatively large distance relative to the housing end 15, but it has not been moved relative to the first piston 6. If pressure medium is now supplied via the pressure medium connection 20, this pressure medium will flow via the interior of the inlet tube 21 and the pressure medium opening 30, into the first chamber 29, thereby displacing the piston 12 towards the housing end 15 until this displacement is no longer possible in the position shown with dash-dot-dot lines at the left in FIG. 2. The piston rod 5 is now in its fully extended position, and the guide member 23 is still guided in the first piston 6. The second piston 12 provides the required electrode force.

To release the pressure which the piston rod 5 exterts, the second chamber 32 is supplied with pressure medium via the pressure medium connection 36. By selecting a suitable magnitude for the pressure in the chambers 32, 29 and 34, the second piston 12 can be displaced in the cavity 11, at the same time as the first piston 6 remains in its position next to the housing end 15. By again generating sufficiently high pressure in the first chamber 29, the piston rod 5 can be extended completely. In order to return the first piston 6 to the position shown in FIG. 2, the pressures in the second chamber 32 and the third chamber 34 are adjusted mutually so that a displacement to the right in FIG. 2 of the first piston 6 is possible. The piston rod 5 is thus retracted completely, when required or convenient for moving or changing the work piece.

The magnitudes of the required pressures in the various chambers in different movements are of course dependent on the size of the effective piston areas in each individual case. In the case shown here, the external diameter of the guide member 23 is less than the diameter of the piston rod 5. Thus a lower pressure is required in the third chamber 34 to displace the first piston 6 to the left in the figure than in the second chamber 32 for displacing the first piston 6 to the right in the figure.

In the housing end 19 there is a cavity 38, into which the guide member 23 protrudes at least partly when the piston rod 5 is completely retracted. This reduces the axial space requirements. Normally, in a cylinder of this type, the length of stroke for the first piston 6 in the housing 7 is greater that the length of stroke for the second piston 12 in the first piston 6. There is of course nothing to prevent one from choosing other embodiments. Normally, air is used as a pressure medium, but other pressure media, such as hydraulic oil, can be used. By making the seals between the moving parts of low friction material, such as Teflon, a minimal friction can be achieved. The seals 33 and 35 actively contribute to the reduction of leakage when the first piston 6 is in either of its two end positions, while the buffer 31 improves the seal between the pistons 6 and 12 when the latter is completely retracted into the former.

The embodiment shown here can of course be varied in a number of different respects, as necessity or desire dictates.

What I claim is:

1. In a cylinder with two-stage movement, in which a first piston which seals against the inside of a housing is axially displaceable in the housing, and in which a second piston, arranged coaxially with the first piston, seals in an axial cavity in one end of the first piston, is axially displaceable in said cavity and carries a piston rod which slides sealingly through one housing end which faces the cavity in the first piston, and in which in the other housing end there is arranged a pressure medium inlet tube which extends through the first piston and into the piston rod, via which tube pressure medium can be brought into or out of a first chamber delimited by the first and the second pistons, and in which second and third chambers in the housing, on the sides of the first and second pistons that face away from each other, have pressure medium connections; the improvement comprising, on the side of the second piston facing away from the piston rod, a tubular, axially oriented guide member which is sealingly guided in the first piston and slides on the inlet tube and seals against the outside of the tube and extends through the first piston, the inlet tube, at its end facing away from the guide member, being movably mounted in said other housing end.

2. A cylinder according to claim 1, characterized in that the guide member is provided with at least one pressure medium opening which opens into the first chamber, via which opening the first chamber communicates with the inlet tube.

3. A cylinder according to claim 1, characterized in that the guide member is disposed, at least in the completely retracted position of the piston rod, to extend into an axial cavity in the second housing end.

4. A cylinder according to claim 1, characterized in that the guide member, when the second piston is maximally extended in the first piston, is at least partially guided in the first piston.

5. A cylinder according to claim 1, characterized in that the outer diameter of the guide member is less than the diameter of the piston rod.

* * * * *